US011555392B2

(12) United States Patent
Jabari et al.

(10) Patent No.: US 11,555,392 B2
(45) Date of Patent: Jan. 17, 2023

(54) METHODS OF COMPLETING A HYDROCARBON WELL

(71) Applicant: ExxonMobil Upstream Research Company, Spring, TX (US)

(72) Inventors: Rami Jabari, The Woodlands, TX (US); P. Matthew Spiecker, Manvel, TX (US); Michael C. Romer, The Woodlands, TX (US); Michael T. Hecker, Tomball, TX (US); Timothy J. Hall, Pinehurst, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 192 days.

(21) Appl. No.: 17/016,513

(22) Filed: Sep. 10, 2020

(65) Prior Publication Data

US 2021/0123335 A1 Apr. 29, 2021

Related U.S. Application Data

(60) Provisional application No. 62/925,336, filed on Oct. 24, 2019.

(51) Int. Cl.

| | |
|---|---|
| ***E21B 43/26*** | (2006.01) |
| ***E21B 33/12*** | (2006.01) |
| ***E21B 43/116*** | (2006.01) |

(52) U.S. Cl.
CPC ..... *E21B 43/261* (2013.01); *E21B 33/12* (2013.01); *E21B 43/116* (2013.01)

(58) Field of Classification Search
CPC ..... E21B 43/261; E21B 33/12; E21B 43/116
See application file for complete search history.

(56) References Cited

U.S. PATENT DOCUMENTS

2001/0050172 A1* 12/2001 Tolman ..... E21B 33/12
166/305.1

* cited by examiner

*Primary Examiner* — Crystal J. Lee
(74) *Attorney, Agent, or Firm* — ExxonMobil Upstream Research Company—Law Department

(57) ABSTRACT

Methods of completing a hydrocarbon well. The methods include establishing a first fluid seal with an isolation device, forming a first perforation with a perforation device, and fracturing a first zone of a subsurface region with a pressurizing fluid stream. The methods also include moving the isolation device and the perforation device in an uphole direction within a tubular conduit of a downhole tubular that extends within a wellbore of the hydrocarbon well. Subsequent to the moving, the methods further include repeating the establishing to establish a second fluid seal, repeating the forming to form a second perforation with the perforation device, and repeating the fracturing to fracture a second zone of the subsurface region.

20 Claims, 6 Drawing Sheets

METHODS OF COMPLETING A HYDROCARBON WELL

CROSS-REFERENCE TO RELATED APPLICATIONS

This application claims the benefit of U.S. Provisional Application No. 62/925,336, filed Oct. 24, 2019, the disclosure of which is herein incorporated by reference.

FIELD OF THE INVENTION

The present disclosure relates generally to methods of completing a hydrocarbon well.

BACKGROUND OF THE INVENTION

Conventional completion operations for hydrocarbon wells utilize a plurality of conventional plugs to fluidly isolate a plurality of spaced-apart stimulation zones from one another during the stimulation process. More specifically, the conventional completion operations generally utilize a first conventional plug, which is positioned within a tubular conduit of a downhole tubular of the hydrocarbon well, to form a first fluid seal within the tubular conduit. The conventional completion operations then perforate and pressurize an uphole region of the downhole tubular, thereby producing fractures within the subterranean formation. A second conventional plug, which is positioned uphole from a first perforated region of the downhole tubular, then is utilized to form a second fluid seal within the tubular conduit. The perforate-pressurize-seal process is repeated a plurality of times to stimulate the plurality of spaced-apart stimulation zones; and, subsequent to the conventional completion operations, the tubular conduit includes a plurality of spaced-apart conventional plugs that must be removed to permit production from the hydrocarbon well.

Some conventional completion operations may utilize soluble conventional plugs that are designed to dissolve after a period of time in contact with wellbore fluids. Some conventional completion operations may utilize a milling device to mill the conventional plugs from the tubular conduit. While effective under certain circumstances, these mechanisms for removal of conventional plugs may be costly and/or unreliable. Thus, there exists a need for improved methods of completing a hydrocarbon well.

SUMMARY OF THE INVENTION

Methods of completing a hydrocarbon well. The methods include establishing a first fluid seal with an isolation device within a tubular conduit of a downhole tubular that extends within a wellbore, which extends within a subsurface region. The methods also include forming a first perforation with a perforation device in a first region of the downhole tubular that is uphole from the isolation device. The methods further include fracturing a first zone of a subsurface region with a pressurizing fluid stream, such as by flowing the pressurizing fluid stream into the subsurface region via the first perforation. The methods also include moving the isolation device and the perforation device in an uphole direction within the tubular conduit such that both the isolation device and the perforation device are uphole from the first perforation. Subsequent to the moving, the methods further include repeating the establishing to establish a second fluid seal with the isolation device, repeating the forming to form a second perforation with the perforation device within a second region of the downhole tubular, and repeating the fracturing to fracture a second zone of the subsurface region.

DETAILED DESCRIPTION OF THE INVENTION

Figure 1:
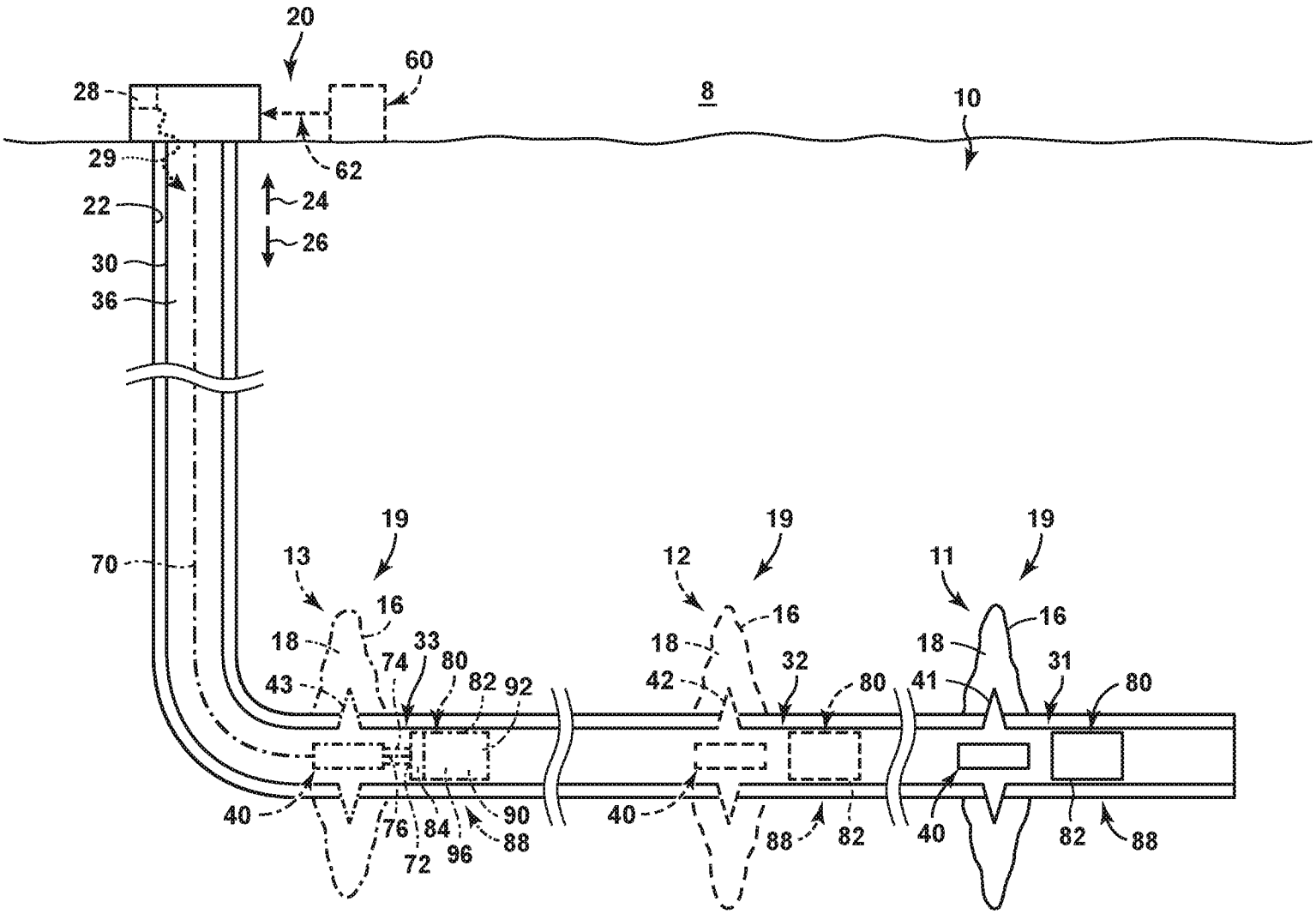
FIG. 1 is a schematic illustration of examples of a hydrocarbon well that may be utilized to perform methods, according to the present disclosure.

FIGS. 1-14 provide examples of hydrocarbon wells 20 and/or of methods 100, according to the present disclosure. Elements that serve a similar, or at least substantially similar, purpose are labeled with like numbers in each of FIGS. 1-14, and these elements may not be discussed in detail herein with reference to each of FIGS. 1-14. Similarly, all elements may not be labeled in each of FIGS. 1-14, but reference numerals associated therewith may be utilized herein for consistency. Elements, components, and/or features that are discussed herein with reference to one or more of FIGS. 1-14 may be included in and/or utilized with any of FIGS. 1-14 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 20 that may be utilized to perform methods 100, according to the present disclosure. As illustrated in FIG. 1, hydrocarbon well 20 includes a wellbore 22 that extends within a subsurface region 10. Wellbore 22 also may be referred to herein as extending between a surface region 8 and subsurface region 10. Hydrocarbon well 20 also includes a downhole tubular 30 that extends within wellbore 22 and defines a tubular conduit 36. Hydrocarbon well 20, and/or wellbore 22 thereof, defines an uphole direction 24, such as may be directed along a length of the wellbore and toward surface region 8, and a downhole direction 26, and such as may be directed along the length of the wellbore and away from surface region 8. In the present disclosure, a first structure may be referred to as being uphole from a second structure. In this context, the first structure and the second structure may be located within wellbore 22 and/or the first structure may be in uphole direction 24 from, or relative to, the second structure, as measured along the length of the wellbore. Similarly, a third structure may be referred to as being downhole from a fourth structure. In this context, the third structure and the fourth structure may be located within wellbore 22 and/or the third structure may be in downhole direction 26 from, or relative to, the fourth structure, as measured along the length of the wellbore.

Hydrocarbon well 20 may include a perforation device 40 and an isolation device 80, which also may be described as being positioned within tubular conduit 36 of hydrocarbon well 20. As discussed in more detail herein with reference to methods 100 of FIG. 2, during operation of hydrocarbon well 20 and/or when completion operations are performed on and/or within hydrocarbon well 20, a single isolation device 80 may be utilized and/or selectively moved, within tubular conduit 36, to permit and/or facilitate stimulation of a plurality of zones of subsurface region 10.

As an example, and as illustrated in solid lines in FIG. 1, isolation device 80 initially may be positioned within a downhole, or within a most downhole, stimulated zone 19 of subsurface region 10. Isolation device 80 may be in an engaged state 88, and/or may form a fluid seal 82 within tubular conduit 36 and/or with downhole tubular 30. Fluid seal 82 that is illustrated in solid lines in FIG. 1 also may be referred to herein as a first fluid seal. As also illustrated in solid lines in FIG. 1, perforation device 40 may be positioned uphole from isolation device 80 and may be utilized to form a first perforation 41, or a plurality of first perforations 41, within a first region 31 of downhole tubular 30 that is uphole from the isolation device. A pressurizing fluid stream 62 then may be supplied to tubular conduit 36, such as from a pressurizing fluid supply system 60, and/or may be utilized to generate a fracture 16, or a plurality of fractures 16, within a first zone 11 of the subsurface region. The pressurizing fluid stream may include a proppant 18, which may prop the fracture open.

As illustrated in dashed lines in FIG. 1, perforation device 40 and isolation device 80 then may be moved in uphole direction 24 within tubular conduit 36 such that both the perforation device and the isolation device are uphole from first perforation 41. Subsequently, and as also illustrated in dashed lines in FIG. 1, a second fluid seal 82 may be established within the tubular conduit. Then, perforation device 40 may be utilized to form a second perforation 42, or a plurality of second perforations 42, within a second region 32 of downhole tubular 30; and pressurizing fluid stream 62 may be utilized to generate a fracture 16 within a second zone 12 of subsurface region 10.

This process may be repeated any suitable number of times. As an example, FIG. 1 illustrates, in dash-dot lines, formation of a third fluid seal 82 with isolation device 80 and subsequent formation of a third perforation 43, or a plurality of third perforations 43, within a third region 33 of downhole tubular 30 that is uphole from second region 32 and also from first region 31. As also illustrated in dash-dot lines, a fracture 16 may be formed within a third zone 13 of subsurface region 10.

Motion of perforation device 40 and/or isolation device 80 in uphole direction 24 may be accomplished in any suitable manner. As an example, and with continued reference to the examples of perforation device 40 and isolation device 80 that are illustrated in dash-dot lines in FIG. 1, an umbilical 70 may extend within tubular conduit 36, may be operatively attached to isolation device 80, and/or may be configured to provide a motive force to move the isolation device in the uphole direction. Examples of the umbilical include coiled tubing, a wireline, and/or a slickline. Umbilical 70 may provide a physical, or a mechanical, connection between the isolation device and the surface region. Additionally or alternatively, the umbilical may be configured to provide electrical power, data, and/or fluid to the wellbore and/or to the isolation device. Stated another way, the umbilical may include and/or may be defined by an electric conduit, a data conduit, and/or a fluid conduit.

In some examples, umbilical 70 may be permanently attached to the isolation device and/or may remain attached to the isolation device during the completion operations. In these examples, a shielding structure 74 may be utilized to shield umbilical 70 from damage, such as may be caused during formation of perforations by perforation device 40 and/or during propping of fracture 16.

In some examples, umbilical 70 may be configured to selectively disengage from, and reengage with, isolation device 80. In these examples, umbilical 70 may include an umbilical-side coupling structure 72 and isolation device 80 may include a corresponding device-side coupling that may be configured to selectively engage with the umbilical-side coupling structure. Also in these examples, umbilical 70 may include and/or may be operatively attached to an umbilical conveyance structure 76, which may be configured to selectively move umbilical 70 within tubular conduit 36 and/or in downhole direction 26.

In some examples, isolation device 80 may include and/or be an autonomous isolation device 80 that may be configured to autonomously move within the tubular conduit 36. In these examples, autonomous isolation device 80 may include a power source 90, a device-side communication structure 92, and/or a device conveyance structure 96. Power source 90 may be configured to power one or more components of autonomous isolation device 80. Device-side communication structure 92 may be configured to communicate with and/or to receive a wireless control signal 29 from a well-side conveyance structure of the hydrocarbon well. Device conveyance structure 96 may be configured to move, or to selectively move, isolation device 80 within tubular conduit 36 and/or in uphole direction 24.

Figure 2:
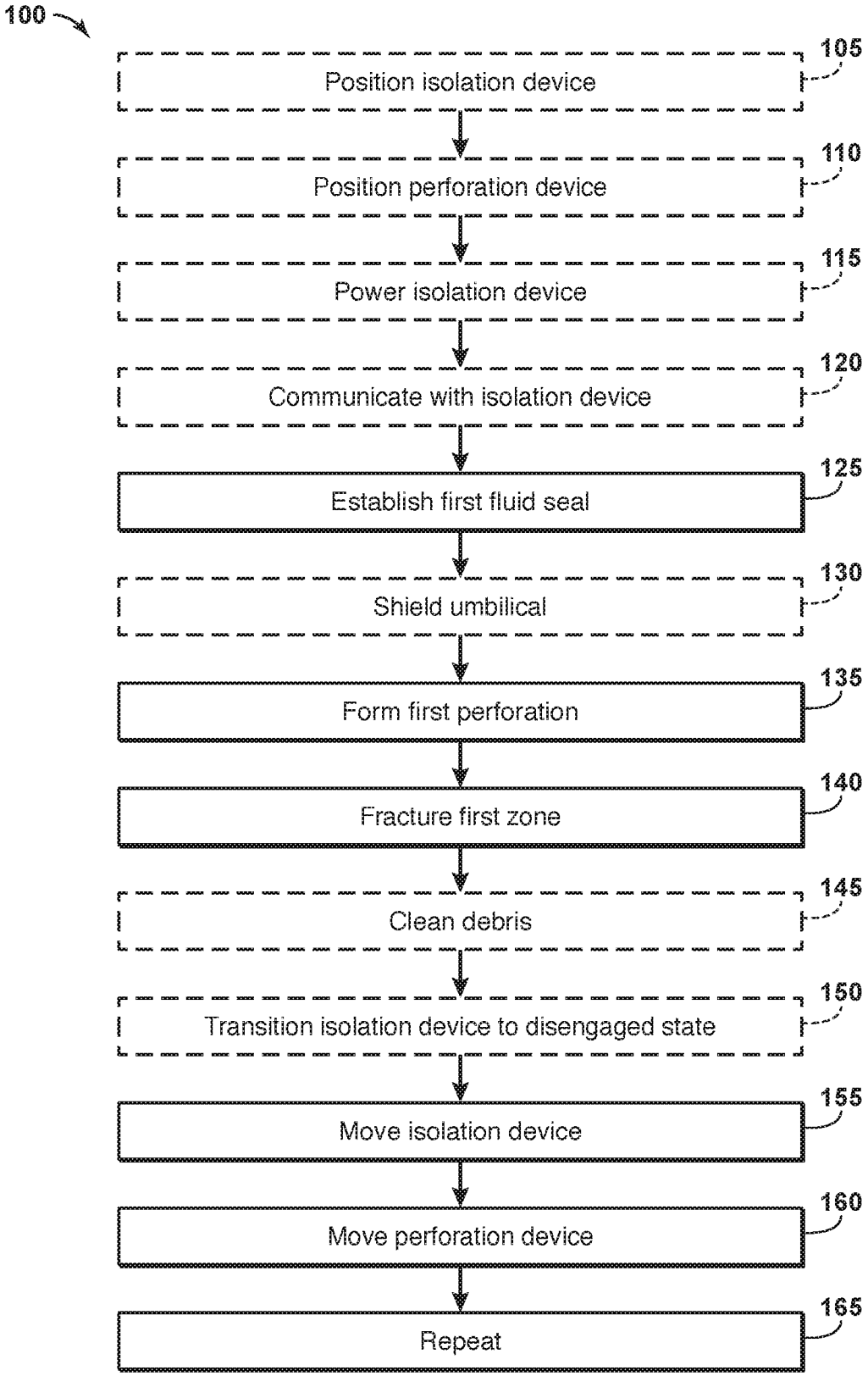
FIG. 2 is a flowchart illustrating examples of methods of completing a hydrocarbon well, according to the present disclosure.

FIG. 2 is a flowchart illustrating examples of methods 100 of completing a hydrocarbon well, such as hydrocarbon well 20 of FIG. 1, according to the present disclosure. FIGS. 3-14 are schematic illustrations of examples of portions of methods 100 of FIG. 2 and/or of portions of hydrocarbon wells 20 of FIG. 1.

Methods 100 may include positioning an isolation device at 105, positioning a perforation device at 110, powering the isolation device at 115, and/or communicating with the isolation device at 120, and methods 100 include establishing a first fluid seal at 125. Methods 100 also may include shielding an umbilical at 130, and methods 100 include forming a first perforation at 135 and fracturing a first zone at 140. Methods 100 further may include cleaning debris at 145, may include transitioning the isolation device to a disengaged state at 150, and include moving the isolation device at 155, moving the perforation device at 160, and repeating at least a subset of the methods at 165.

Positioning the isolation device at 105 may include positioning any suitable isolation device within the tubular conduit and/or within a target, or a desired, region of the tubular conduit. An example of the isolation device includes a downhole plug. The positioning at 105 may include positioning the isolation device in any suitable manner. As an example, the positioning at 105 may include flowing the isolation device in a downhole direction within the tubular conduit.

The positioning at 105 may be performed with any suitable timing and/or sequence during methods 100. As examples, the positioning at 105 may be performed prior to the positioning at 110, at least partially concurrently with the positioning at 110, and/or prior to the establishing at 125.

Figure 3:
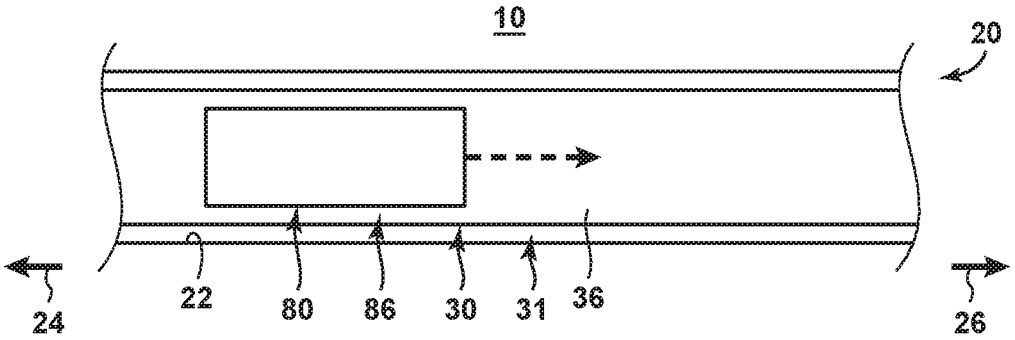
FIG. 3 is a schematic illustration of examples of a portion of the methods of FIG. 2.

The positioning at 105 is illustrated in FIG. 3. As illustrated therein, and indicated by the dashed arrow, the positioning at 105 may include flowing an isolation device 80 in a downhole direction 26 within a tubular conduit 36 of a downhole tubular 30. The downhole tubular may extend within a wellbore 22 that extends within a subsurface region 10. In the example of FIG. 3, the target, or desired, region of tubular conduit 36 may be defined by first region 31 of the downhole tubular.

As also illustrated in FIG. 3, isolation device 80 may be in a disengaged state 86 during the positioning at 105. While in disengaged state 86, the isolation device may be shaped, sized, and/or configured to move within tubular conduit 36 and/or to not engage with downhole tubular 30. Stated another way, when in disengaged state 86, the isolation device may be free, or at least substantially free, to move within the tubular conduit.

Positioning the perforation device at 110 may include positioning any suitable perforation device within the tubular conduit, within a target, or a desired, region of the tubular conduit, and/or uphole from the isolation device. Examples of the perforation device include a perforation gun and/or a shaped-charge perforation device. The positioning at 110 may include positioning the perforation device in any suitable manner. As an example, the positioning at 110 may include flowing the perforation device in a downhole direction within the tubular conduit.

The positioning at 110 may be performed with any suitable timing and/or sequence during methods 100. As examples, the positioning at 110 may be performed subsequent to the positioning at 105, at least partially concurrently with the positioning at 105, prior to the establishing at 125, and/or prior to the forming at 135.

Figure 4:
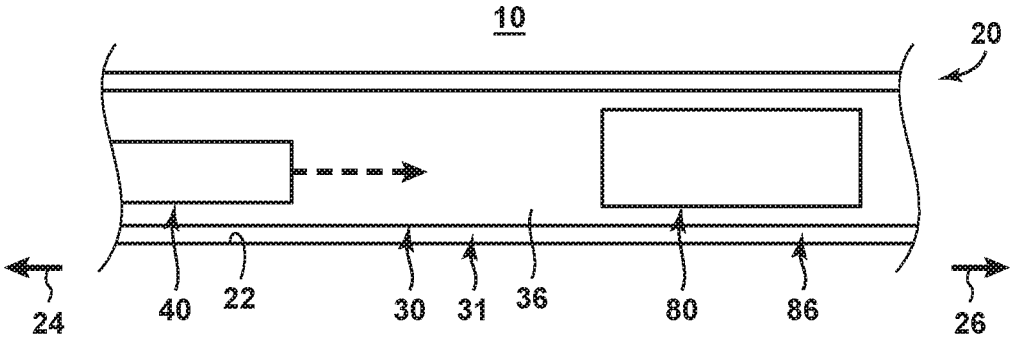
FIG. 4 is a schematic illustration of examples of a portion of the methods of FIG. 2.

The positioning at 110 is illustrated in FIG. 4. As illustrated therein, and indicated by the dashed arrow, the positioning at 110 may include flowing a perforation device 40 in a downhole direction 26 within tubular conduit 36 of downhole tubular 30.

In some examples, and as discussed in more detail herein, the isolation device may be selectively and/or permanently attached to an umbilical, such as umbilical 70 of FIGS. 1, 6-8, and 10-11. In these examples, methods 100 may include powering the isolation device at 115 with, via, and/or utilizing an umbilical. The powering at 115 may include powering in any suitable manner and/or utilizing any suitable power source. As examples, the powering at 115 may include electrically, mechanically, hydraulically, pneumatically, and/or chemically powering the isolation device.

The powering at 115 may be performed with any suitable timing and/or sequence during methods 100. As examples, the powering at 115 may be performed prior to, at least partially concurrently with, concurrently with, after, and/or to facilitate one or more of the communicating at 120, the establishing at 125, the cleaning at 145, the transitioning at 150, the moving at 155, and/or the repeating at 165.

In examples of methods 100 where the isolation device is selectively and/or permanently attached to the umbilical, methods 100 further may include communicating with the isolation device at 120 with, via, and/or utilizing the umbilical. The communicating at 120 may include communicating via the umbilical in any suitable manner. As examples, the communicating at 120 may include conveying any suitable wired control signal to the isolation device via the umbilical and/or receiving any suitable wired status signal from the isolation device via the umbilical.

Establishing the first fluid seal at 125 may include establishing any suitable first fluid seal, within the tubular conduit and with the isolation device, in any suitable manner. As an example, and as discussed, the isolation device may be in the disengaged state during the positioning at 105. In this example, the establishing at 125 may include transitioning the isolation device from the disengaged state to an engaged state. When in the engaged state the isolation device may operatively engage with the downhole tubular and/or may form the fluid seal with the downhole tubular.

Transitioning the isolation device from the disengaged state to the engaged state may be performed in any suitable manner. As an example, the transitioning may include actuating a sealing structure of the isolation device. As a more specific example, the sealing structure may include a resilient sealing structure, and the establishing may include compressing the resilient sealing structure such that the resilient sealing structure selectively expands, radially expands, operatively engages with the downhole tubular, and/or forms the fluid seal with the downhole tubular. The resilient sealing structure additionally or alternatively may be configured to selectively contract, radially contract, disengage from the downhole tubular, and/or cease the fluid seal with the downhole tubular, such as to permit and/or facilitate subsequent motion of the isolation device within the tubular conduit.

As discussed, and in some examples, the isolation device may be selectively or permanently attached to the umbilical. In these examples, the establishing at 125 may include utilizing the umbilical to transition the isolation device from the disengaged state to the engaged state. This may include electrically, mechanically, hydraulically, pneumatically, and/or chemically powering the isolation device, or the sealing structure of the isolation device, with, via, and/or utilizing the umbilical to transition the isolation device from the disengaged state to the engaged state.

The establishing at 125 may be performed with any suitable timing and/or sequence during methods 100. As examples, the establishing at 125 may be performed subsequent to the positioning at 105, subsequent to the positioning at 110, and/or prior to the forming at 135.

Figure 5:
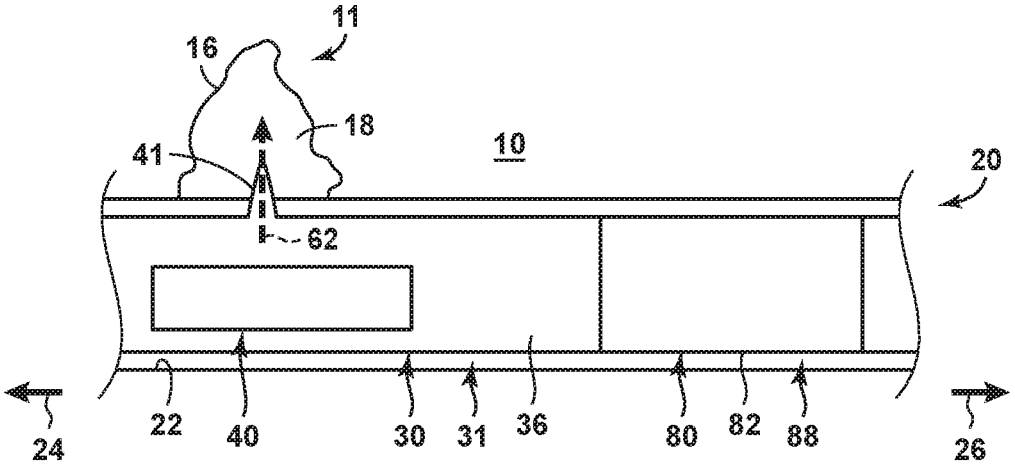
FIG. 5 is a schematic illustration of examples of a portion of the methods of FIG. 2.

The establishing at 125 is illustrated in FIG. 5. As illustrated therein, isolation device 80 may be transitioned to an engaged state 88 such that the isolation device forms a fluid seal 82 with downhole tubular 30.

In examples of methods 100 where the isolation device is selectively or permanently attached to the umbilical, methods 100 further may include shielding the umbilical at 130. The shielding at 130 may include shielding the umbilical to prevent, or to decrease a potential for, damage to the umbilical during one or more other steps of methods 100. As examples, the shielding at 130 may include shielding the umbilical from the perforation device during the forming at 135 and/or during the repeating at 165. As additional examples, the shielding at 130 may include shielding the umbilical from a proppant that may be utilized during the fracturing at 140 and/or during the repeating at 165.

The shielding at 130 may be performed with any suitable timing and/or sequence during methods 100. As examples, the shielding at 130 may be performed prior to the forming at 135, during the forming at 135, prior to the fracturing at 140, and/or during the fracturing at 140.

Forming the first perforation at 135 may include forming the first perforation, or a plurality of first perforations, with the perforation device and/or within a first region of the downhole tubular. Stated another way, the forming at 135 may include perforating the first region of the downhole tubular with, via, and/or utilizing the perforation device. The first region of the downhole tubular may be uphole from the isolation device. Examples of the perforation device include a perforation gun and/or a shaped-charge perforation device. With this in mind, the forming at 135 additionally or alternatively may be referred to herein as urging a first projectile through the first region of the downhole tubular.

The forming at 135 may be performed with any suitable timing and/or sequence during methods 100. As examples, the forming at 135 may be performed subsequent to the positioning at 105, subsequent to the positioning at 110, subsequent to the establishing at 125, subsequent to the shielding at 130, prior to the moving at 155, and/or prior to the moving at 160.

The forming at 135 is illustrated in FIG. 5. As illustrated therein, perforation device 40 has been utilized to form a first perforation 41 within first region 31 of downhole tubular 30.

Fracturing the first zone at 140 may include fracturing a first zone of the subsurface region with a pressurizing fluid stream and/or by flowing the pressurizing fluid stream into the subsurface region with, via, and/or utilizing the first perforation. This may include creating a first fracture, or a plurality of first fractures, within the first zone of the subsurface region. In some examples, the fracturing at 140 further may include propping the first zone of the subsurface region with a first proppant, which may be provided to the first zone of the subsurface region in and/or within the pressurizing fluid stream. An example of the proppant includes a particulate material configured to prop the first fracture open and/or to increase fluid flow within, or fluid permeability of, the first fracture.

The fracturing at 140 may be performed with any suitable timing and/or sequence during methods 100. As examples, the fracturing at 140 may be performed subsequent to the positioning at 105, subsequent to the positioning at 110, subsequent to the establishing at 135, prior to the moving at 155, prior to the moving at 160, and/or prior to the repeating at 165.

The fracturing at 140 is illustrated in FIG. 5. As illustrated therein, a fracture 16, which also may be referred to herein as a first fracture, may be formed within first zone 11 of subsurface region 10, such as via flow of a pressurizing fluid stream 62 into the first zone of the subsurface region via first perforation 41. Fracture 16 may be propped by a proppant 18, which may flow into the fracture with and/or within the fracturing fluid stream.

As discussed, and in some examples, the umbilical may be temporarily and/or selectively attached to and/or engaged with the isolation device. In these examples, the isolation device may include a device-side coupling structure, and the umbilical may include an umbilical-side coupling structure that may be configured to selectively and/or operatively couple, or dock, with the device-side coupling structure. Also in these examples, subsequent to the umbilical being disengaged with the isolation device and/or prior to the umbilical being reengaged with the isolation device, methods 100 may include cleaning debris at 145. Cleaning debris at 145 may include cleaning debris from the device-side coupling structure and/or cleaning debris from the umbilical-side coupling structure, such as to permit and/or facilitate operative coupling, or docking, between the device-side coupling structure and the umbilical-side coupling structure.

The cleaning at 145 may be accomplished in any suitable manner. As an example, a fluid jet may be directed into the device-side coupling structure and/or into the umbilical-side coupling structure to clean debris from the corresponding coupling structure.

Transitioning the isolation device to the disengaged state at 150 may include transitioning the isolation device to the disengaged state to permit and/or facilitate the moving at 155. Additionally or alternatively, the transitioning at 150 may include ceasing the establishing at 125 and/or de-establishing the fluid seal. This may include contracting the resilient sealing structure, radially contracting the resilient sealing structure, disengaging the resilient sealing structure from the downhole tubular, and/or ceasing the fluid seal with the downhole tubular via the resilient sealing structure. When the isolation device is in the disengaged state, the isolation device may be free to move within the tubular conduit.

Moving the isolation device at 155 may include moving the isolation device in an uphole direction within the tubular conduit such that the isolation device is uphole from the first perforation. Similarly, moving the perforation device at 160 may include moving the perforation device in the uphole direction within the fluid conduit such that the perforation device is uphole from the first perforation and/or such that the perforation device is uphole from the isolation device. In some examples, the moving at 155 and the moving at 160 may be performed independently, or at least partially independently, of one another. As an example, methods 100 may include performing the moving at 160 at least partially subsequent to the moving at 155.

The moving at 155 and the moving at 160 may be performed with any suitable timing and/or sequence during methods 100. As examples, the moving at 155 and/or the moving at 160 may be performed subsequent to the forming at 135, subsequent to the fracturing at 140, subsequent to the transitioning at 150, and/or prior to the repeating at 165.

Repeating at least the subset of the methods at 165 may include repeating any suitable step and/or steps of methods 100 in any suitable order. In one example, the repeating at 165 may include repeating the establishing at 125 to establish a second fluid seal with the isolation device and/or within the tubular conduit. In this example, the repeating at 165 also may include repeating the forming at 135 to form a second perforation within a second region of the downhole tubular that is uphole from the isolation device and/or that also is uphole from the first perforation. Also in this example, the repeating at 165 may include repeating the fracturing at 140 to fracture a second zone of the subsurface region that may be uphole from the first zone of the subsurface region.

The repeating the forming at 135 may include perforating the second region of the downhole tubular and/or forming a second perforation, or a plurality of second perforations, within the second region of the downhole tubular. This may include urging a second projectile, or a plurality of second projectiles, through the second region of the downhole tubular. The second perforation may be uphole from the first perforation.

In some examples, the repeating at 165 may include performing at least the moving at 155, the moving at 160, the establishing at 125, the forming at 135, and the fracturing at 140 a plurality of times to fracture and/or to stimulate a plurality of spaced-apart zones of the subsurface region. The plurality of spaced-apart zones of the subsurface region may include at least 2, at least 4, at least 6, at least 8, at least 10, at least 15, at least 20, at least 30, at least 40, or at least 50 spaced-apart zones of and/or within the subsurface region. A distance between a most uphole zone and a most downhole zone of the plurality of spaced-apart zones of the subsurface region may be at least 10 meters, at least 25 meters, at least 50 meters, at least 100 meters, at least 250 meters, at most 500 meters, at most 1,000 meters, at most 2,000 meters, at most 3,000 meters, at most 4,000 meters, at most 5,000 meters, and/or at most 10,000 meters.

In some examples, the isolation device may include and/or be a single isolation device that may be utilized during the establishing at 125 and also during the repeating at 165. In these examples, the single isolation device may remain within the tubular conduit during an entirety of methods 100 and/or may remain within the tubular conduit at least during the establishing at 125 and until completion of the repeating at 165. Stated another way, the single isolation device, or only one isolation device, may be utilized to stimulate a plurality of zones of the subsurface region, with this single isolation device being progressively moved in an uphole direction between successive stimulation steps and/or to facilitate stimulation of successive zones of the subsurface region. Stated yet another way, the single isolation device may be utilized to complete an entirety of the hydrocarbon well and/or to form all completions within a region of the wellbore that extends within a hydrocarbon reservoir of the subsurface region.

In some examples, the single isolation device may be utilized to complete a subset of, or even all of, the zones of the hydrocarbon well that are beyond the reach of coiled tubing and/or workover strings. Such a configuration may decrease a need for the utilizing of soluble plugs during completion of the hydrocarbon well. In some examples, the single isolation device may be utilized to complete some or all zones of the hydrocarbon well that are greater than a threshold distance from the surface region, as measured along a length of the tubular conduit. Examples of the threshold distance from the surface region include 500 meters, 1,000 meters, 2,500 meters, 5,000 meters, and/or 10,000 meters.

The repeating at 165 may be performed with any suitable timing and/or sequence during methods 100. As examples, the repeating at 165 may be performed subsequent to, or subsequent to an initial instance of, the positioning at 105, the positioning at 110, the establishing at 125, the shielding at 130, the forming at 135, the fracturing at 140, the moving at 155, and/or the moving at 160.

More detailed and/or specific examples of methods 100 are discussed below. These more detailed examples of methods 100 may include and/or utilize any suitable combination of steps, structures, and/or features disclosed herein.

Figure 6:
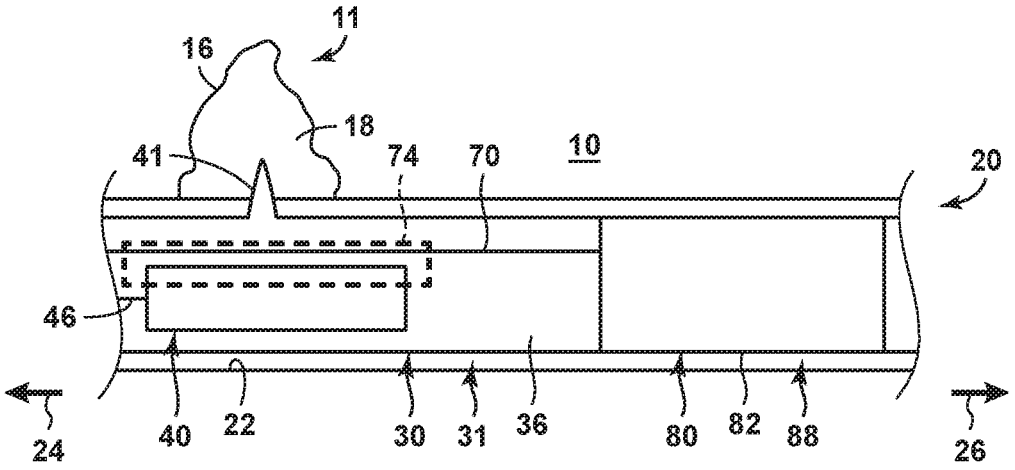
FIG. 6 is a schematic illustration of examples of a portion of the methods of FIG. 2.
Figure 7:
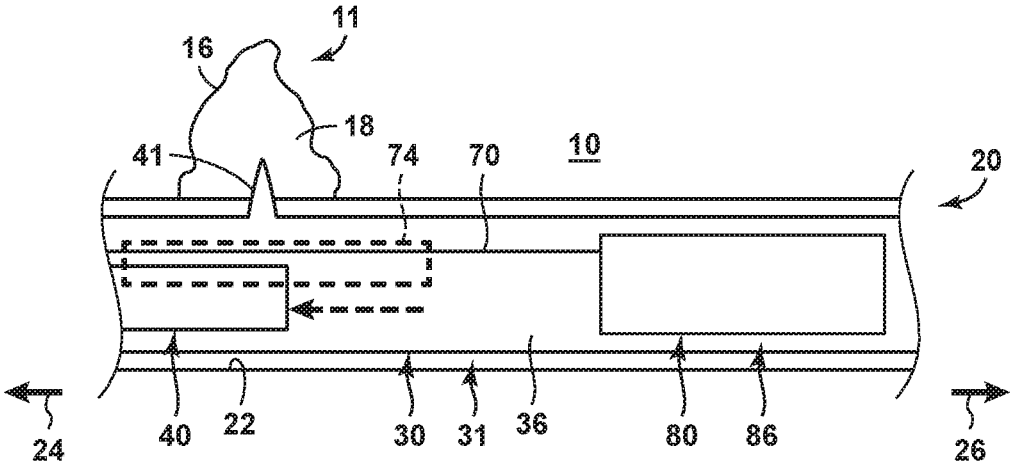
FIG. 7 is a schematic illustration of examples of a portion of the methods of FIG. 2.
Figure 8:
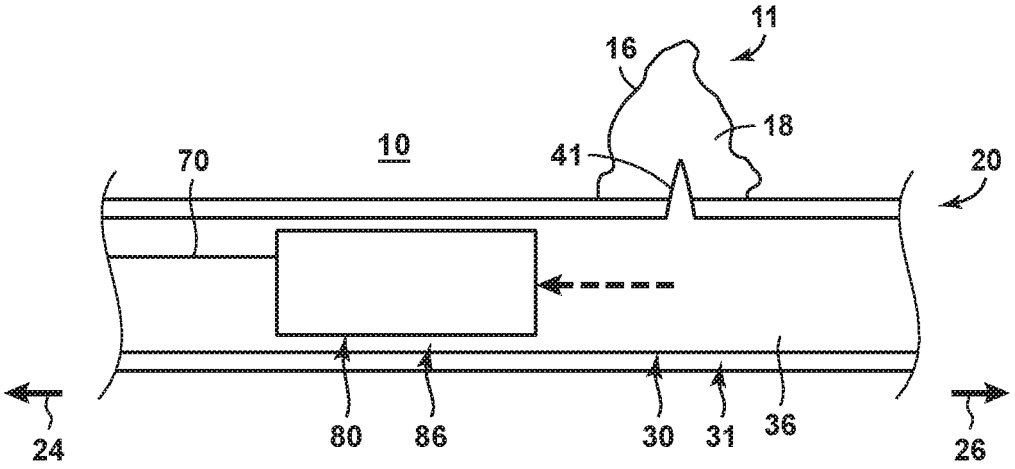
FIG. 8 is a schematic illustration of examples of a portion of the methods of FIG. 2.

As discussed, in some examples, the isolation device may be permanently attached to the umbilical, at least while being utilized during methods 100. In such an example, the umbilical is not configured to be selectively attached (i.e., undocked) from, and reattached (i.e., redocked) to the isolation device. Stated another way, the umbilical may extend between the isolation device and the surface region and/or may be operatively attached to the isolation device during at least the establishing at 125, the forming at 135, the fracturing at 140, the moving at 155, the moving at 160, and/or the repeating at 165. Such a configuration is illustrated in FIGS. 6-8 and discussed in more detail herein.

In these examples, methods 100 may include performing the establishing at 125 and performing the shielding at 130 prior to and/or during the forming at 135 and/or the fracturing at 140 to shield the umbilical from damage that may be caused by the perforation device and/or by the proppant. An example of such methods is illustrated in FIG. 6. As illustrated therein, a shielding structure 74 may, or may be utilized to, shield umbilical 70 from damage. In some examples, the shielding structure may be operatively attached to and/or may form a portion of perforation device 40. In some examples, the shielding structure may be spaced-apart from the perforation device and/or may be operatively attached to the umbilical and/or to the isolation device. Examples of the shielding structure include an abrasion-resistant structure, a puncture-resistant structure, and/or a structure that positions the umbilical, relative to the perforation device, such that the perforation device does not damage the umbilical.

Also in these examples, subsequent to the fracturing at 140 and prior to the moving at 155 and the moving at 160, methods 100 may include performing the transitioning at 150. In these examples, the transitioning at 150 may include transitioning the isolation device to the disengaged state and/or transitioning the isolation device from the engaged state to the disengaged state, as illustrated by the transition of isolation device 80 from engaged state 88 of FIG. 6 to disengaged state 86 of FIG. 7. As discussed, the transitioning at 150 may include transition with, via, and/or utilizing the isolation device, such as by performing the powering at 115 to power the isolation device and/or to effect the transitioning at 150.

Also in these examples, the moving at 155 may include applying a motive force to the isolation device with the umbilical, to move the isolation device in the uphole direction within the tubular conduit. An example of this moving at 155 is illustrated in FIG. 8, wherein umbilical 70 is operatively attached to isolation device 80 and is applying a motive force to the isolation device to urge, or to move, the isolation device in uphole direction 24, as indicated by the dashed arrow in FIG. 8. This includes moving the isolation device uphole from first perforation 41 and/or from first zone 11 of subsurface region 10, as discussed in more detail herein.

Figure 9:
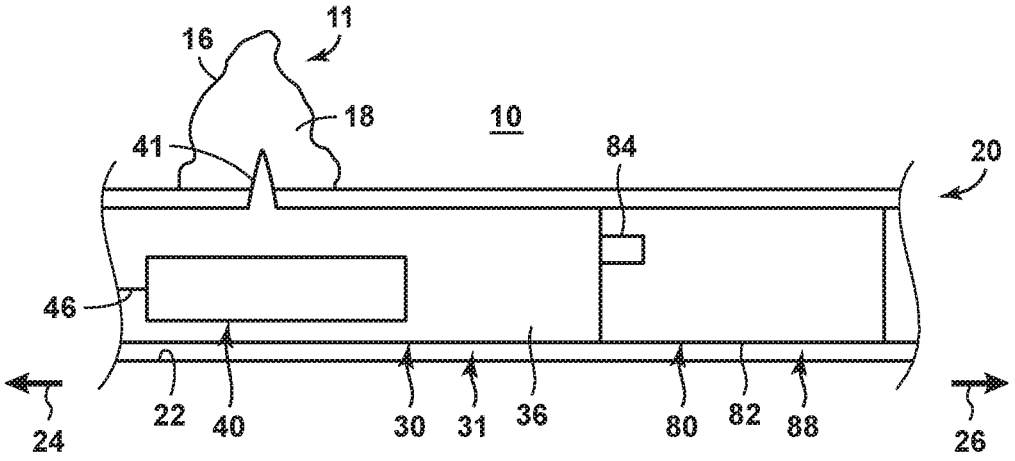
FIG. 9 is a schematic illustration of examples of a portion of the methods of FIG. 2.
Figure 10:
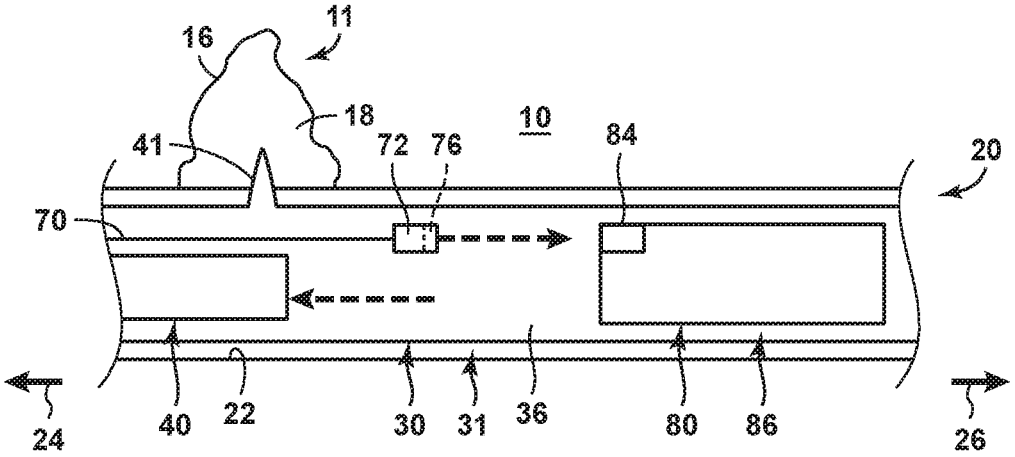
FIG. 10 is a schematic illustration of examples of a portion of the methods of FIG. 2.
Figure 11:
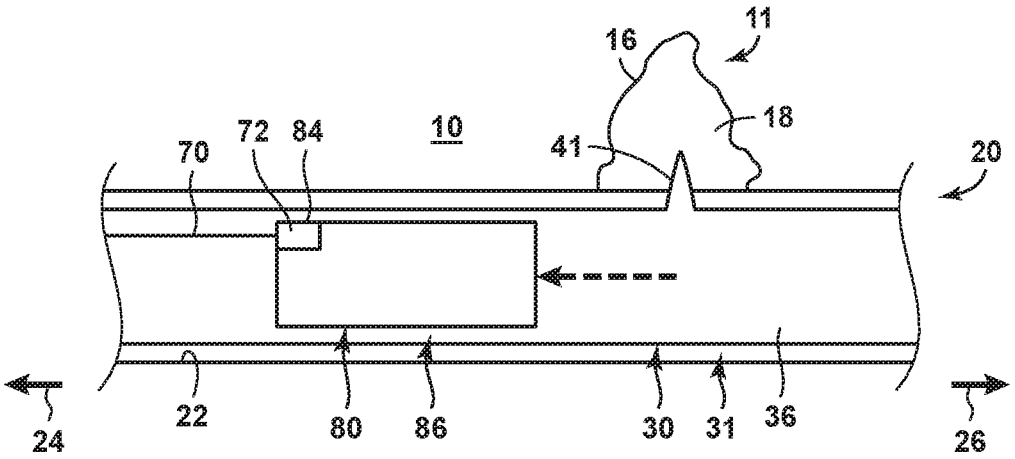
FIG. 11 is a schematic illustration of examples of a portion of the methods of FIG. 2.

As also discussed, in some examples, the isolation device may be selectively and/or intermittently attached to, connected to, interfaced with, and/or docked with the umbilical during methods 100. Stated another way, the isolation device may be docked with the umbilical during a first subset of the steps of methods 100 and may be undocked from the umbilical during a second subset of the steps of methods 100. Such a configuration is illustrated in FIGS. 9-11 and discussed in more detail herein.

In these examples, subsequent to the positioning at 105, subsequent to the establishing at 125, prior to the forming at 135, and/or prior to the fracturing at 140, methods 100 may include undocking the umbilical from the isolation device. An example of the undocking is illustrated in FIG. 9, where isolation device 80 includes device-side coupling structure 84, which is configured to interface with an umbilical-side coupling structure of the umbilical; however, the umbilical is not operatively attached to, or is undocked from, the isolation device. Such a configuration may permit and/or facilitate performing the forming at 135 and/or the fracturing at 140 without the need to perform the shielding at 130. Stated another way, the undocking may permit the umbilical to be moved away from the perforation device, thereby decreasing a potential for damage to the umbilical during the forming at 135 and/or during the fracturing at 140.

Also in these examples, subsequent to the forming at 135, subsequent to the fracturing at 140 and/or prior to, during, and/or as part of the moving at 155, methods 100 may include docking the umbilical with the isolation device; and, subsequent to the docking, performing the transitioning at 150 to transition the isolation device to the disengaged state and/or from the engaged state to the disengaged state. An example of the docking is illustrated by the transition from FIG. 10, where the umbilical is undocked from the isolation device, to FIG. 11, where the umbilical is docked with the isolation device. As illustrated in FIG. 10, umbilical 70 may include and/or may be operatively attached to an umbilical-side coupling structure 72 that may, as illustrated in FIG. 11, interface and/or dock with device-side coupling structure 84 of isolation device 80. As discussed in more detail herein, and prior to the docking, methods 100 may include performing the cleaning at 145 to clean debris from the umbilical-side coupling structure and/or from the device-side coupling structure.

In such an example, the moving at 155 may include applying a motive force to the isolation device, with the umbilical, to move the isolation device in the uphole direction within the tubular conduit. An example of this moving is illustrated in FIG. 11, wherein umbilical 70 is operatively attached to isolation device 80 and is applying a motive force to the isolation device to urge, or to move, the isolation device in uphole direction 24, as indicated by the dashed arrow in FIG. 11. This includes moving the isolation device uphole from first perforation 41 and/or from first zone 11 of subsurface region 10, as discussed in more detail herein.

It is within the scope of the present disclosure that the umbilical may dock with the isolation device in any suitable manner and/or that any suitable motive force may be utilized to move the umbilical toward and/or into engagement with the isolation device. As an example, the docking the umbilical with the isolation device may include conveying the umbilical in the downhole direction via gravity, such as when the umbilical is positioned within a vertical and/or deviated region of the wellbore. As another example, the docking the umbilical with the isolation device may include flowing the umbilical in the downhole direction within an injected fluid stream. As yet another example, the docking the umbilical with the isolation device may include urging the umbilical in the downhole direction utilizing an umbilical conveyance structure that may be operatively attached to the umbilical, as indicated in FIG. 10 at 76. Examples of the umbilical conveyance structure include a tractor, a propeller, an impeller, and/or a fluid jet.

In some examples, the isolation device may include and/or be an autonomous isolation device. The autonomous isolation device, when utilized, may be configured to autonomously perform at least a subset of the steps of methods 100. Stated another way, the autonomous isolation device may perform the subset of the steps of methods 100 under its own power, under its own direction, and/or without being urged and/or directed by another structure, such as an umbilical. Stated yet another way, the autonomous isolation device may not be operatively coupled to, or may be free of attachment to, an umbilical. Stated another way, the autonomous isolation device may be configured for independent action and/or motion within tubular conduit 36.

As an example, the autonomous isolation device may autonomously perform the establishing at 125. Stated another way, the establishing at 125 may include autonomously establishing the first fluid seal with the autonomous isolation device. As another example, the autonomous isolation device may autonomously repeat the establishing at 125 during the repeating at 165. This is illustrated in FIG. 12, where autonomous isolation device 80 has autonomously transitioned to engaged state 88 and/or has autonomously established fluid seal 82.

As yet another example, the autonomous isolation device may autonomously perform the moving at 155. Stated another way, the moving at 155 may include autonomously moving the autonomous isolation device under its own power and/or by its own direction. An example of this autonomous moving is illustrated in FIGS. 13-14, where autonomous isolation device 80 has autonomously transitioned to disengaged state 86 and autonomously moves in uphole direction 24, such as via and/or utilizing a device conveyance structure 96 of the autonomous isolation device.

Figure 12:
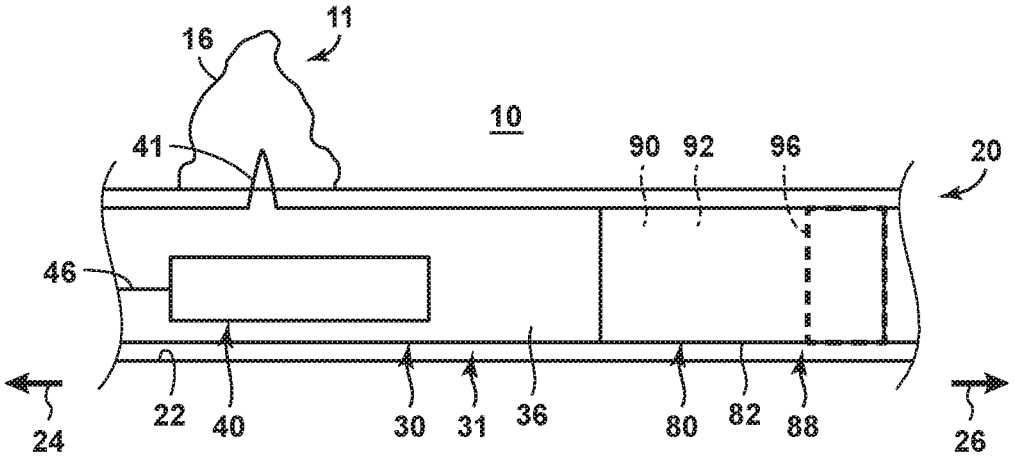
FIG. 12 is a schematic illustration of examples of a portion of the methods of FIG. 2.
Figure 13:
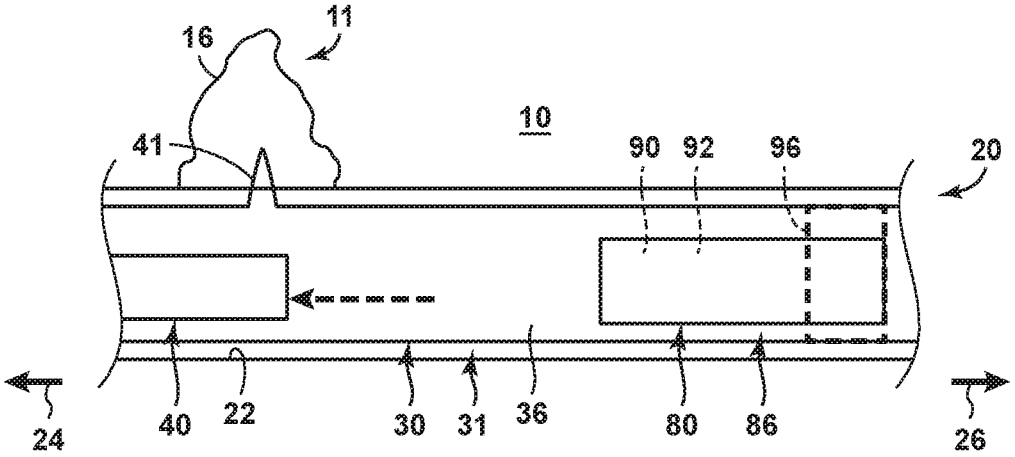
FIG. 13 is a schematic illustration of examples of a portion of the methods of FIG. 2.
Figure 14:
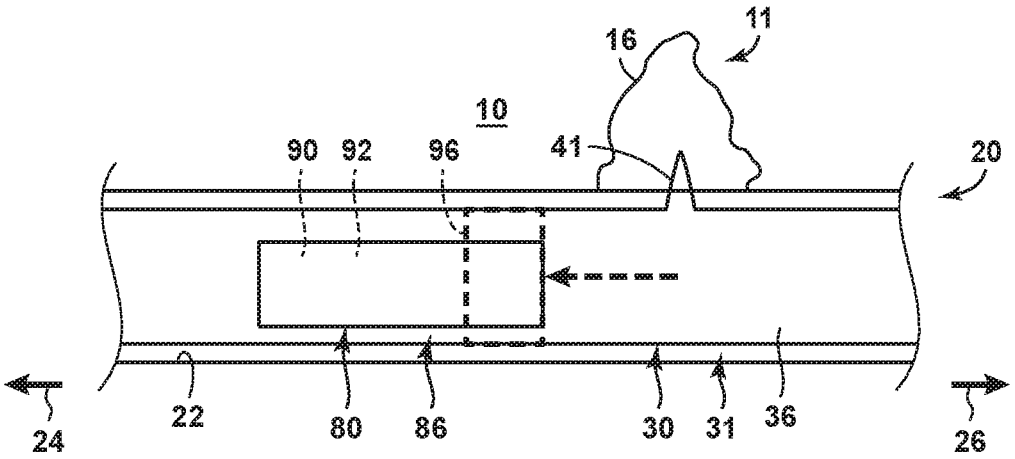
FIG. 14 is a schematic illustration of examples of a portion of the methods of FIG. 2.

In some examples, and as illustrated in FIGS. 12-14, an autonomous isolation device 80 may include a power source 90 that may be configured to power the autonomous isolation device and/or to power at least one other component of the autonomous isolation device. In these examples, the establishing at 125 and/or repeating the establishing at 125 during the repeating at 165 may include utilizing the power source to transition the isolation device to the engaged state and/or to transition the isolation device from the disengaged state to the engaged state. Also in these examples, the moving at 155 may include utilizing the power source to transition the isolation device to the disengaged state and/or to power device conveyance structure 96 of the isolation device. The device conveyance structure may be configured to move the isolation device within the tubular conduit and/or to provide a motive force for motion of the isolation device within the tubular conduit. Examples of the device conveyance structure include a tractor, an isolation device-attached tractor, a motorized device conveyance structure, and/or an electrically powered device conveyance structure.

In some examples, and as also illustrated in FIGS. 12-14, autonomous isolation device 80 may include a device-side communication structure 92 that may be configured to receive a wireless control signal, such as from well-side communication device 28 of FIG. 1. In these examples, methods 100 may include providing the wireless control signal to the autonomous isolation device. Also in these examples, the autonomous isolation device may be configured to perform, or to autonomously perform, one or more actions within tubular conduit 36 responsive to receipt of the wireless control signal. As examples, the autonomous isolation device may be configured to perform the establishing at 125, the moving at 155, and/or to repeat the establishing at 125 during the repeating at 165 responsive to receipt of the wireless control signal.

In any and/or all of the above examples, and as illustrated by the transition from FIG. 6 to FIG. 7, by the transition from FIG. 9 to FIG. 10, and/or by the transition from FIG. 12 to FIG. 13, perforation device 40 may be operatively attached to a perforation device umbilical 46. The perforation device umbilical may be utilized to urge, or to move, the perforation device in uphole direction 24 during the moving at 160, as indicated by the dashed arrow in FIGS. 7, 10, and 13.

Also in any and/or all of the above examples, the perforation device may be selectively and/or intermittently removed from the downhole tubular, such as to permit and/or facilitate replacement, replenishment, and/or reloading of the perforation device. As an example, the moving at 160 may include removing the perforation device from the downhole tubular and/or positioning the perforation device in the surface region. In such an example, methods 100 further may include repositioning the perforation device within the tubular conduit and uphole from the isolation device. The repositioning may be performed with any suitable timing and/or sequence during methods 100. As examples, the repositioning may be performed during the repeating at 165, subsequent to repeating the positioning at 105, as part of repeating the positioning at 110, prior to repeating the establishing at 125, subsequent to repeating the establishing at 125, and/or prior to the forming at 135.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas, well drilling, and/or well completion industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of completing a hydrocarbon well, the method comprising:

establishing, with an isolation device, a first fluid seal within a tubular conduit of a downhole tubular, wherein the downhole tubular extends within a wellbore that extends within a subsurface region;

while the first fluid seal is established, forming, with a perforation device, a first perforation within a first region of the downhole tubular that is uphole from the isolation device;

fracturing, with a pressurizing fluid stream, a first zone of the subsurface region by flowing the pressurizing fluid stream into the subsurface region via the first perforation;

moving the isolation device and the perforation device in an uphole direction within the tubular conduit such that both the isolation device and the perforation device are uphole from the first perforation; and subsequent to the moving:

(i) repeating the establishing, with the isolation device, to establish a second fluid seal within the tubular conduit;

(ii) while the second fluid seal is established, repeating the forming, with the perforation device, to form a second perforation within a second region of the downhole tubular that is uphole from the isolation device; and (iii) repeating the fracturing to fracture a second zone of the subsurface region.

2. The method of claim 1, wherein the isolation device is operatively attached to an umbilical, wherein, subsequent to the fracturing and prior to the moving, the method further includes transitioning the isolation device to a disengaged state in which the isolation device is free to move within the tubular conduit, and further wherein the moving the isolation device includes applying a motive force to the isolation device, with the umbilical, to move the isolation device in the uphole direction within the tubular conduit.

3. The method of claim 2, wherein at least one of:

(i) the umbilical extends between the isolation device and a surface region during the establishing;

(ii) the umbilical extends between the isolation device and the surface region during the forming;

(iii) the umbilical extends between the isolation device and the surface region during the fracturing; and (iv) the umbilical extends between the isolation device and the surface region during the moving.

4. The method of claim 2, wherein the method further includes at least one of:

(i) shielding the umbilical from the perforation device during the forming;

(ii) shielding the umbilical from the perforation device during the repeating the forming;

(iii) shielding the umbilical from a proppant during the fracturing; and (iv) shielding the umbilical from the proppant during the repeating the fracturing.

5. The method of claim 2, wherein at least one of:

(i) the establishing the first fluid seal includes utilizing the umbilical to transition the isolation device from the disengaged state to an engaged state; and (ii) the repeating the establishing includes utilizing the umbilical to transition the isolation device from the disengaged state to the engaged state.

6. The method of claim 5, wherein the method further includes powering the isolation device via the umbilical.

7. The method of claim 5, wherein the method further includes communicating with the isolation device via the umbilical.

8. The method of claim 1, wherein the isolation device is configured to selectively interface with an umbilical while the isolation device is positioned within the tubular conduit, and further wherein the moving the isolation device includes:

(i) docking the umbilical with the isolation device; and (ii) transitioning the isolation device to a disengaged state in which the isolation device is free to move within the tubular conduit;

wherein the moving the isolation device includes applying a motive force to the isolation device, with the umbilical, to move the isolation device in the uphole direction within the tubular conduit.

9. The method of claim 8, wherein, subsequent to the docking, the umbilical extends between the isolation device and a surface region.

10. The method of claim 8, wherein the isolation device includes a device-side coupling structure, wherein the umbilical includes an umbilical-side coupling structure configured to selectively and operatively couple with the device-side coupling structure during the docking, and further wherein, prior to the docking, the method further includes at least one of:

(i) cleaning debris from the device-side coupling structure; and (ii) cleaning debris from the umbilical-side coupling structure.

11. The method of claim 8, wherein, prior to the repeating the forming, the moving the isolation device further includes undocking the umbilical from the isolation device.

12. The method of claim 8, wherein the moving the perforation device includes removing the perforation device from the downhole tubular, and further wherein, subsequent to the repeating the establishing, the method further includes repositioning the perforation device within the tubular conduit and uphole from the isolation device.

13. The method of claim 8, wherein the docking the umbilical with the isolation device includes at least one of:

(i) conveying the umbilical in a downhole direction via gravity;

(ii) flowing the umbilical in the downhole direction within an injected fluid stream; and (iii) urging the umbilical in the downhole direction utilizing an umbilical conveyance structure that is operatively attached to the umbilical.

14. The method of claim 1, wherein the isolation device is an autonomous isolation device and further wherein at least one of:

(i) the establishing the first fluid seal includes autonomously establishing the first fluid seal;

(ii) the moving the isolation device includes autonomously moving the isolation device; and (iii) the repeating the establishing includes autonomously establishing the second fluid seal.

15. The method of claim 14, wherein the isolation device further includes a power source configured to power the isolation device, and further wherein at least one of:

(i) the establishing the first fluid seal includes utilizing the power source to transition the isolation device from a disengaged state to an engaged state;

(ii) the moving the isolation device includes utilizing the power source to power a device conveyance structure of the isolation device;

(iii) the moving the isolation device includes utilizing the power source to transition the isolation device from the engaged state to the disengaged state; and (iv) the repeating the establishing includes utilizing the power source to transition the isolation device from the disengaged state to the engaged state.

16. The method of claim 14, wherein the method further includes providing a wireless control signal to the isolation device.

17. The method of claim 16, wherein at least one of:

(i) the establishing the first fluid seal includes establishing the first fluid seal responsive to receipt of the wireless control signal;

(ii) the moving the isolation device includes moving the isolation device responsive to receipt of the wireless control signal; and (iii) the repeating the establishing includes establishing the second fluid seal responsive to receipt of the wireless control signal.

18. The method of claim 1, wherein the establishing the fluid seal includes transitioning the isolation device from a disengaged state to an engaged state.

19. The method of claim 1, wherein the isolation device is a single isolation device that is utilized during the establishing the first fluid seal and also during the repeating the establishing to establish the second fluid seal.

20. The method of claim 1, wherein the method includes performing the moving, the repeating the establishing, the repeating the forming, and the repeating the fracturing to fracture a plurality of spaced-apart zones of the subsurface region.

* * * * *